US007509776B2

(12) United States Patent
Reisman

(10) Patent No.: US 7,509,776 B2
(45) Date of Patent: Mar. 31, 2009

(54) MODULAR STORAGE SHED SYSTEM

(75) Inventor: Ron Reisman, Netzer-Sereni (IL)

(73) Assignee: Arrow Group Industries, Inc., Wayne, NJ (US)

( * ) Notice: Subject to any disclaimer, the term of this patent is extended or adjusted under 35 U.S.C. 154(b) by 829 days.

(21) Appl. No.: 11/068,660

(22) Filed: Feb. 28, 2005

(65) Prior Publication Data

US 2006/0191209 A1 Aug. 31, 2006

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***E04B 9/00*** | (2006.01) |
| ***E04B 2/30*** | (2006.01) |
| ***E04B 1/00*** | (2006.01) |
| ***E04B 2/00*** | (2006.01) |
| ***E06B 3/54*** | (2006.01) |
| ***E04C 2/34*** | (2006.01) |
| ***E04C 3/00*** | (2006.01) |

(52) U.S. Cl. ..... 52/281; 52/479; 52/483.1; 52/489.1; 52/481.1; 52/481.2; 52/582.1; 52/461; 52/90.1; 52/79.12; 403/DIG. 10

(58) Field of Classification Search ..... 52/36.1, 52/36.2, 79.1, 79.2, 79.12, 79.5, 479, 483.1, 52/489.1, 481.1, 481.2, 582.1, 283, 284, 52/762, 763, 90.1, 511, 281, 464, 468, 235; 403/DIG. 10, 329

See application file for complete search history.

(56) References Cited

U.S. PATENT DOCUMENTS

| | | | | | |
|---|---|---|---|---|---|
| 921,163 | A * | 5/1909 | Rhoads | ..... | 52/464 |
| 1,506,442 | A * | 8/1924 | O'Hara | ..... | 52/762 |
| 1,826,133 | A * | 10/1931 | Hatch | ..... | 52/772 |
| 2,998,112 | A * | 8/1961 | Burgin | ..... | 52/772 |
| 3,028,938 | A * | 4/1962 | Schorr | ..... | 52/464 |
| 3,034,609 | A * | 5/1962 | Young | ..... | 52/241 |
| 3,236,014 | A * | 2/1966 | Edgar | ..... | 52/270 |

(Continued)

FOREIGN PATENT DOCUMENTS

EP 476289 A1 * 3/1992

(Continued)

*Primary Examiner*—Robert J Canfield
*Assistant Examiner*—Ryan Franks
(74) *Attorney, Agent, or Firm*—Carter, DeLuca, Farrell & Schmidt LLP.

(57) ABSTRACT

A modular storage shed system is provided, including an upper frame assembly having a plurality of vertically oriented posts, each post defining an elongated slot extending axially along at least a portion of a length thereof, a plurality of external wall panels each defining a pair of side edges, each wall panel including a lip extending orthogonally from at least a portion of each side edge thereof and defining at least one aperture formed therein. There is provided a plurality of panel locks having a lock member. The lock member may snap-fit engage the apertures in the lips of the wall panels when the lips of adjacent wall panels are positioned within the slot of a common vertical post and when the lock member of the panel lock is pressed between the adjacent wall panels into the slot of the vertical post.

12 Claims, 15 Drawing Sheets

U.S. PATENT DOCUMENTS 3,448,554 A * 6/1969 Apesteguy ..... 52/461
3,609,933 A * 10/1971 Martin ..... 52/461
3,667,183 A * 6/1972 Heirich ..... 52/506.06
3,751,865 A * 8/1973 Brigham ..... 52/92.2
4,000,596 A * 1/1977 Magill et al. ..... 52/481.2
4,570,392 A * 2/1986 Oltman et al. ..... 52/64
5,277,002 A * 1/1994 Haag ..... 52/90.1
5,293,725 A * 3/1994 Matticks et al. ..... 52/271
5,579,624 A * 12/1996 Aeberhard ..... 52/586.2
5,592,794 A * 1/1997 Tundaun ..... 52/220.7
5,692,345 A * 12/1997 Mogaki et al. ..... 52/483.1
5,758,466 A * 6/1998 Tucker ..... 52/586.2
5,845,446 A * 12/1998 Funaki et al. ..... 52/461
5,901,528 A * 5/1999 Richardson ..... 52/783.1
5,975,660 A * 11/1999 Tisbo et al. ..... 312/263
6,042,296 A * 3/2000 Wittig et al. ..... 403/298
6,076,328 A 6/2000 Danhof et al.
6,192,643 B1 * 2/2001 Zadok ..... 52/648.1
6,202,382 B1 * 3/2001 Conterno ..... 52/762
6,250,022 B1 * 6/2001 Paz et al. ..... 52/79.5
6,415,558 B1 * 7/2002 Cherry ..... 52/79.1
6,418,672 B1 * 7/2002 Hampel ..... 52/79.1
6,519,900 B1 * 2/2003 Pierce ..... 52/66
6,536,175 B2 * 3/2003 Conterno ..... 52/489.1
6,543,197 B2 4/2003 Wetzel, III et al.
6,550,216 B1 * 4/2003 Ohanesian ..... 52/783.11
6,581,337 B1 * 6/2003 Skov et al. ..... 52/79.5
6,604,328 B1 * 8/2003 Paddock ..... 52/93.1
6,648,542 B2 * 11/2003 Smith et al. ..... 403/291
6,668,514 B2 * 12/2003 Skov ..... 52/782.1
6,701,678 B1 * 3/2004 Skov et al. ..... 52/79.9
6,823,639 B2 * 11/2004 Hampel ..... 52/598
6,892,497 B2 * 5/2005 Moon et al. ..... 52/79.1
6,907,695 B2 * 6/2005 Pierce ..... 52/66
6,968,661 B2 * 11/2005 Kopish et al. ..... 52/489.1
7,395,634 B2 * 7/2008 Anderson et al. ..... 52/79.1
7,441,379 B2 * 10/2008 Konstantin ..... 52/200
2001/0022058 A1 * 9/2001 Conterno ..... 52/489.1
2002/0170242 A1 * 11/2002 Skov ..... 52/79.1
2002/0174532 A1 * 11/2002 Skov et al. ..... 29/453
2003/0029100 A1 * 2/2003 Wetzel, III et al. ..... 52/79.1
2004/0074158 A1 * 4/2004 De Zen ..... 52/79.9
2004/0187402 A1 * 9/2004 Moon et al. ..... 52/79.5
2005/0120641 A1 * 6/2005 Whitehead et al. ..... 52/79.1
2005/0144857 A1 * 7/2005 Guerrero ..... 52/79.1
2005/0210765 A1 * 9/2005 Mower et al. ..... 52/79.5
2005/0210766 A1 * 9/2005 Mower et al. ..... 52/79.5
2005/0223652 A1 * 10/2005 Mower et al. ..... 52/79.1
2005/0223653 A1 * 10/2005 Mower et al. ..... 52/79.1
2005/0223655 A1 * 10/2005 Mower et al. ..... 52/79.5
2005/0279034 A1 * 12/2005 Tsang ..... 52/79.1
2006/0156643 A1 * 7/2006 Lin et al. ..... 52/79.1
2006/0191209 A1 * 8/2006 Reisman ..... 52/36.2
2007/0044391 A1 * 3/2007 Richardson et al. ..... 52/79.1
2007/0157530 A1 * 7/2007 Uffner et al. ..... 52/90.1
2007/0175108 A1 * 8/2007 Stein et al. ..... 52/79.5
2007/0209295 A1 * 9/2007 Mower et al. ..... 52/79.1
2007/0283630 A1 * 12/2007 Kasdorf et al. ..... 52/36.1
2008/0134610 A1 * 6/2008 Jakob-Bamberg et al. .. 52/489.1

FOREIGN PATENT DOCUMENTS

JP 05302425 A * 11/1993
WO WO 9411588 A1 * 5/1994

* cited by examiner

MODULAR STORAGE SHED SYSTEM

BACKGROUND

1. Technical Field

The present disclosure relates generally to building structures and systems and, more particularly, to storage building structures (e.g., modular storage shed systems) and apparatus for connecting wall panel members of the storage building structure to an underlying frame assembly.

2. Background of Related Art

Prefabricated buildings, such as storage buildings or sheds, are intended to be purchased, assembled, and maintained by consumers who do not necessarily have the training or inclination to assemble and maintain such a structure, particularly if such assembly and/or maintenance requires a great deal of skill.

Accordingly, prefabricated metal storage buildings have been developed that include pre-punched fastener holes and other design features that simplify the assembly of such a storage building. However, such designs typically require a relatively large number of threaded fasteners (e.g., 600 or more threaded fasteners), such as screws and bolts, for a typical storage building having a length of about 8 feet (about 2.4 meters) and a width of about 10 feet (about 3 meters). This large number of threaded fasteners causes the assembly, maintenance and disassembly of a storage building to be a time consuming and tedious task, especially for the typical consumer who is not accustomed to assembling storage buildings.

Assembly could be simplified by providing only a few but relatively large portions of the storage building to the ultimate purchaser. For example, each portion could comprise either an integral or preassembled major component (such as an entire wall). However, such an approach is inconsistent with the need to package the unassembled storage building in a relatively small shipping container to enable the consumer to easily transport it from the place of purchase to the site on which the storage building is to be erected.

SUMMARY

In accordance with an aspect of the present disclosure, a modular storage shed system is provided. The modular storage shed system includes an upper frame assembly having a plurality of vertically oriented posts, each post defining an elongated slot extending axially along at least a portion of a length thereof. The modular storage shed system further includes an external skin assembly having a plurality of external wall panels each defining a pair of side edges. Each wall panel includes a lip extending orthogonally from at least a portion of each side edge thereof. Each lip defines at least one aperture formed therein. The external skin assembly also includes a plurality of panel locks having an elongate strip, a lock member extending orthogonally from and at least along a portion of a length of the elongate strip, and resilient tabs projecting outwardly from each side of the lock member. The tabs may snap-fit engage the apertures in the lips of the wall panels when the lips of adjacent wall panels are positioned within the slot of a common vertical post and when the lock member of the panel lock is pressed between the adjacent wall panels into the slot of the vertical post.

Desirably, the tabs taper downwardly in a distal direction. It is envisioned that a distal edge of each tab is integral with the lock member and a rear and side edges of each tab is separated from the lock member.

It is envisioned that the storage shed system may further include a roof frame assembly including a plurality of rafters. Each rafter defines a channel extending axially along at least a portion of a length thereof. The storage shed system may further include a roof skin assembly having a plurality of roof panels each defining a pair of side edges. Each roof panel may include a lip extending orthogonally from at least a portion of each side edge thereof. Each lip desirably defines at least one aperture formed therein. The roof skin assembly further includes a plurality of roof panel locks having an elongate strip, a lock member extending orthogonally from and at least along a portion of a length of the elongate strip, and resilient tabs projecting outwardly from each side of the lock member. The tabs of the roof panel lock desirably snap-fit engage the apertures in the lips of the roof panels when the lips of adjacent roof panels are positioned within the channel of a common rafter and the lock member of the roof panel lock is pressed between the adjacent roof panels into the channel of the rafter.

The storage shed system may further include an internal skin assembly having a plurality of inner wall panels. Desirably, each inner wall panel includes at least one recess formed along each side edge thereof, and a series of tabs extending along at least one of an upper and a lower edge thereof. The internal skin assembly further includes a plurality of inner wall snaps having a biasing member configured to snap-fit engage apertures formed in the vertical posts.

It is envisioned that each vertical post includes a series of apertures formed therein. Desirably, the apertures formed in the vertical post are disposed along a side opposite the vertical slot.

Desirably, each inner wall snap includes a V-shaped biasing member having a first side member and a second member, and a tab extending outwardly from each of the first and second side members. Inner wall snaps have an un-biased condition in which the tabs are spaced a distance from one another and a biased condition in which the tabs are in relative close proximity to one another. Inner wall snaps deflect to the biased condition upon pushing inner wall snaps into the apertures of the vertical posts. Additionally, the inner wall snaps return to the un-biased condition when the tabs of the first and second side members completely enter the aperture of the vertical post.

Desirably, the roof skin assembly further includes a pair of gable caps each configured to operatively engage the roof frame assembly. Each gable cap may include a facie, a bullnose provided at an upper edge of the facie, a lower hook extending from a rear surface of the facie proximate a lower end thereof, and an upper hook extending from the rear surface of the facie proximate an upper end thereof. Desirably, the lower hook is configured to operatively engage an upper rail of the upper frame assembly and the upper hook is configured to operatively engage a ridge cap post of the roof frame assembly.

In one embodiment, the storage shed system further includes a base panel assembly configured and dimensioned to support the upper frame thereon. The base panel assembly includes a plurality of base panels configured and dimensioned to selectively engage one another. It is envisioned that the edges of the base panels which are to engage one another have a stepped profile. The stepped edges of the base panels include a series of upper teeth configured and dimensioned to operatively engage a series of lower teeth provided on the stepped edge of an adjacent base panel. At least one tooth of the series of lower teeth provided along a stepped side edge of the base panel may include an engaging member projecting therefrom. The projecting member is desirably configured to operatively engage a juxtaposed upper tooth of the series of upper teeth provided along a stepped side edge of an adjacent base panel.

According to another aspect of the present disclosure, panel locks for use with a modular storage shed, are provided. Each panel lock includes an elongate strip having a first side and a second side, a flange extending orthogonally from and at least along a portion of a length of the second side of the elongate strip, and a plurality of snap lock members formed in flange. Each snap lock member includes a first and a second tab projecting from either side thereof. The tabs snap-fit engage the apertures in the lips of the wall panels when the lips of adjacent wall panels are positioned within the slot of a common vertical post and the lock member of the panel lock is pressed between the adjacent wall panels into the slot of the vertical post.

DETAILED DESCRIPTION OF PREFERRED EMBODIMENTS

Figure 1:
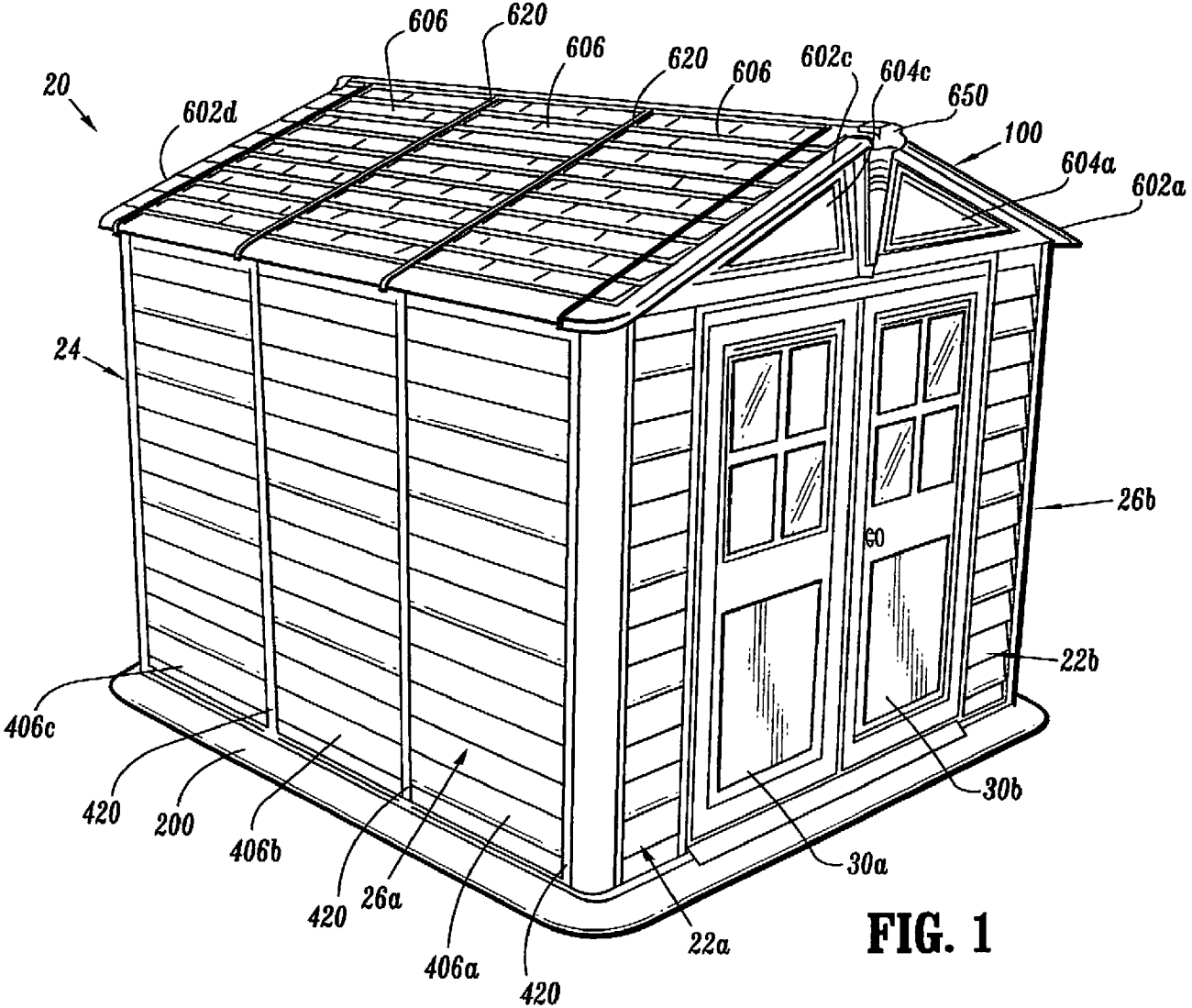
FIG. 1 is a perspective view of a modular storage shed system according to an embodiment of the present disclosure.
Figure 2:
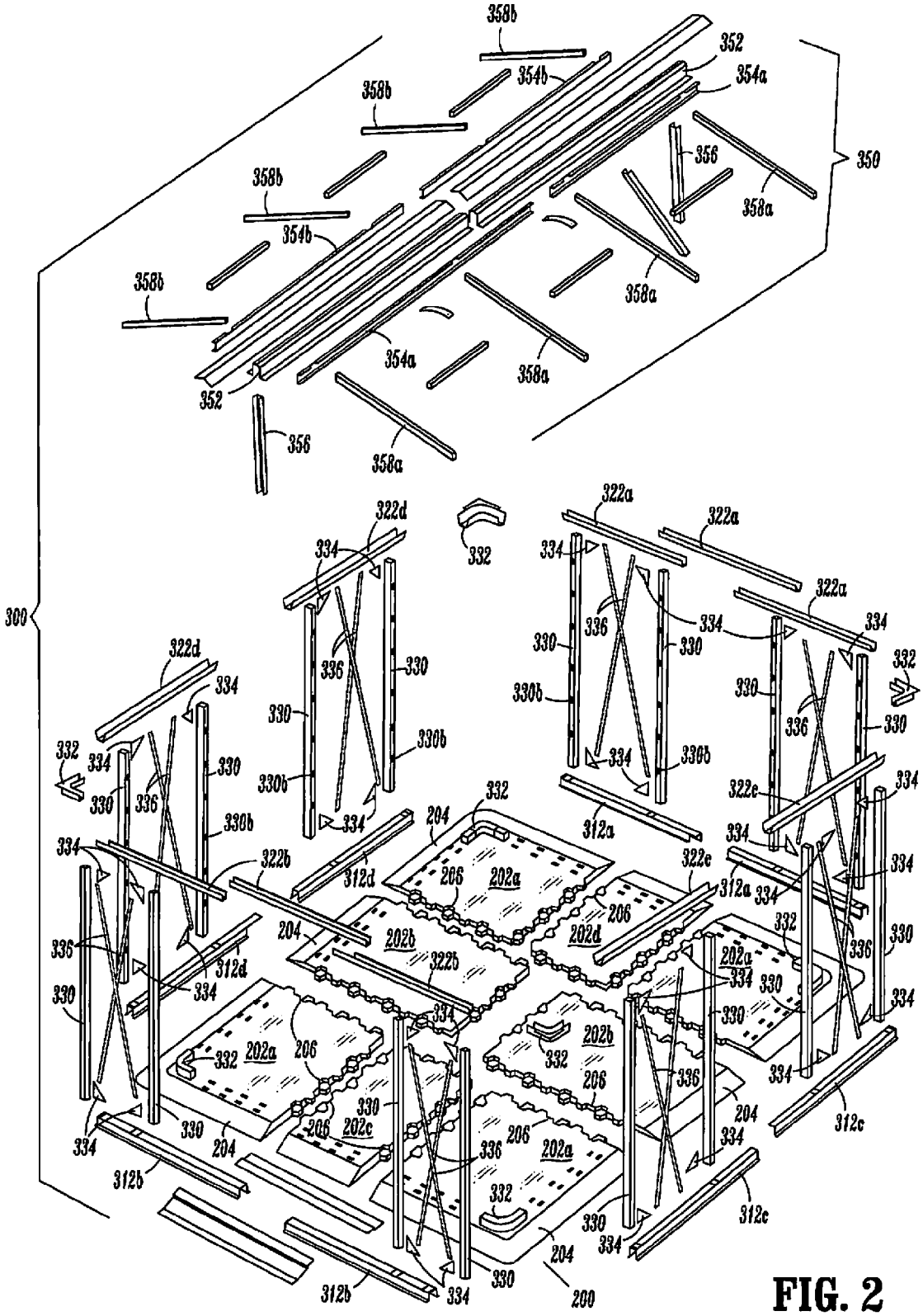
FIG. 2 is an exploded view of an upper frame and roof assemblies of the modular storage shed system of FIG. 1.
Figure 3:
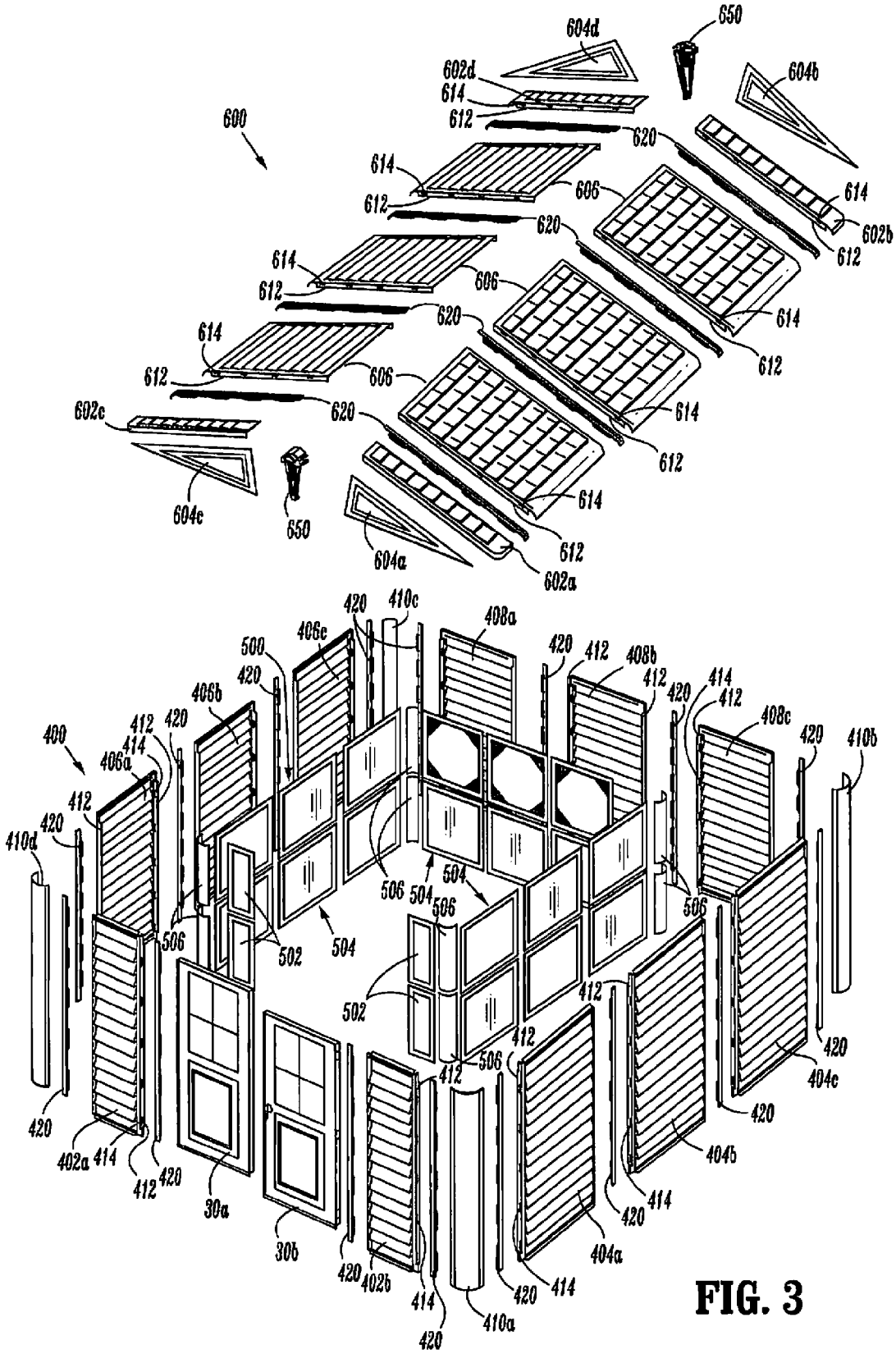
FIG. 3 is an exploded view of an external, internal and roof skin assemblies of the modular storage shed system of FIG. 1.

Referring initially to FIGS. 1-3, a modular storage shed system, in accordance with an embodiment of the present disclosure is generally designated 20. Modular storage shed system 20 includes a first front wall 22*a*, a second front wall 22*b*, a rear wall 24, a first side wall 26*a* and a second side wall 26*b*, and first and second door assemblies 30*a*, 30*b*, respectively. First and second door assemblies 30*a*, 30*b* are desirably operatively associated (e.g., hingedly connected) between first and second front walls 22*a*, 22*b*. Modular storage shed system 20 further includes a roof frame assembly 350, a base panel assembly 200, and an upper frame assembly 300 (see FIGS. 2 and 4). As will be described in greater detail below and as seen in FIG. 3, storage shed system 20 includes an external skin assembly 400, an internal skin assembly 500, and a roof skin assembly 600.

Storage shed system 20 desirably has a generally rectangular floor plan. For example, storage shed system 20 may have a width (measured along the rear wall 24) of about 96.5 inches, a length (measured along one of side walls 26*a*, 26*b*) of about 73.1 inches, a wall height of about 62.0 inches, and a total height (from the ground to the top of roof assembly 100) of about 73.8 inches. While particular dimensions for storage shed assembly 20 are provided, it is understood that storage shed system 20 may have any dimension without departing from the novel features of the present disclosure.

Figure 4:
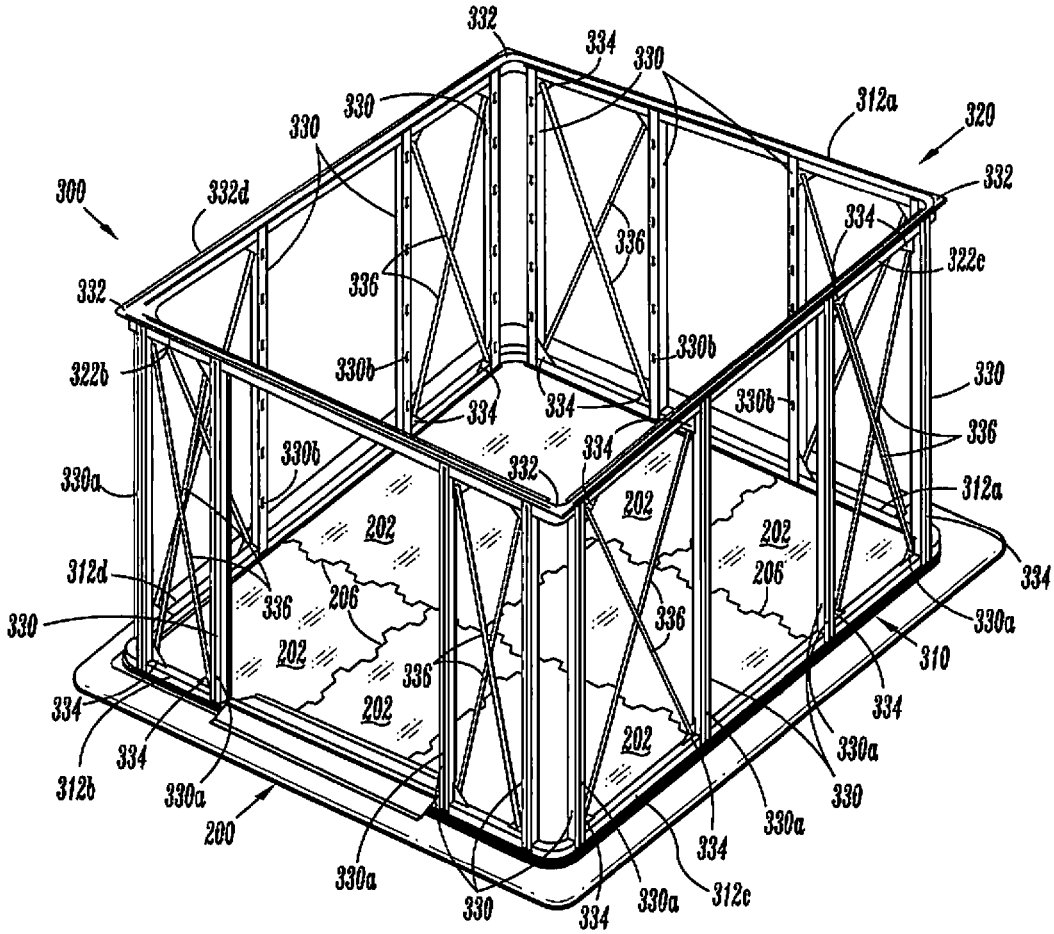
FIG. 4 is a perspective view of the upper frame assembly, in an assembled condition, disposed on the base frame assembly.

Turning now to FIGS. 2 and 4, storage shed system 20 may include a base panel assembly 200 on which upper frame assembly 300 is mounted and/or supported. As will be described in greater detail below, base panel assembly 200 may be modular and include a plurality of base corner panels 202*a*, base side middle panels 202*b*, a base front center panel 202*c*, and a base rear center panel 202*d* which may be joined together to define and form base panel assembly 200. While FIG. 2 illustrates base panel assembly 200 as having base side middle panels 202*b*, and base front and rear center panels 202*c*, 202*d*, it is envisioned and within the scope of the present disclosure that storage shed system 20 may be constructed with either no base middle panels 202*b* or base center panels 202*c*, 202*d*, or any number of base side middle panels 202*b* depending on the size of storage shed system 200 needed and/or desired.

Upper Frame Assembly

As seen in FIGS. 2 and 4, upper frame assembly 300 includes a lower rail assembly 310 defining the perimeter of storage shed system 20 and providing the structure to which first front wall 22*a*, second front wall 22*b*, rear wall 24, first side wall 26*a* and second side wall 26*b* are connected. Lower rail assembly 310 includes a rear lower rail 312*a*, a front lower rail 312*b*, a first side lower rail 312*c* and a second side lower rail 312*d*. Additionally, upper frame assembly 300 includes an upper rail assembly 320 having a rear upper rail 322*a*, a front upper rail 322*b*, a first side upper rail 322*c* and a second side upper rail 322*d*.

Upper frame assembly 300 further includes a plurality of vertical posts 330 operatively connected to and interconnecting upper rail assembly 320 to lower rail assembly 310. Desirably, corner connectors 332 may be provided to interconnect the ends of rear upper rail 322*a*, front upper rail 322*b*, first side upper rail 322*c* and second side upper rail 322*d* to one another. Corner connectors 332 may further be provided to interconnect the ends of rear lower rail 312*a*, front lower rail 312*b*, first side lower rail 312*c*, and second side lower rail 312*d*.

Desirably, corner gussets 334 may be used to interconnect each vertical post 330 to lower rail assembly 310 and to upper rail assembly 320. Corner gussets 334 help to maintain posts 330 vertical as well as to increase the strength of upper frame assembly 300. Optionally, it is desirable that diagonal braces 336 may extend between and interconnect diagonally opposed corner gussets 334 located along upper rail assembly 320 to corner gussets 334 located along lower rail assembly 310.

Figure 5:
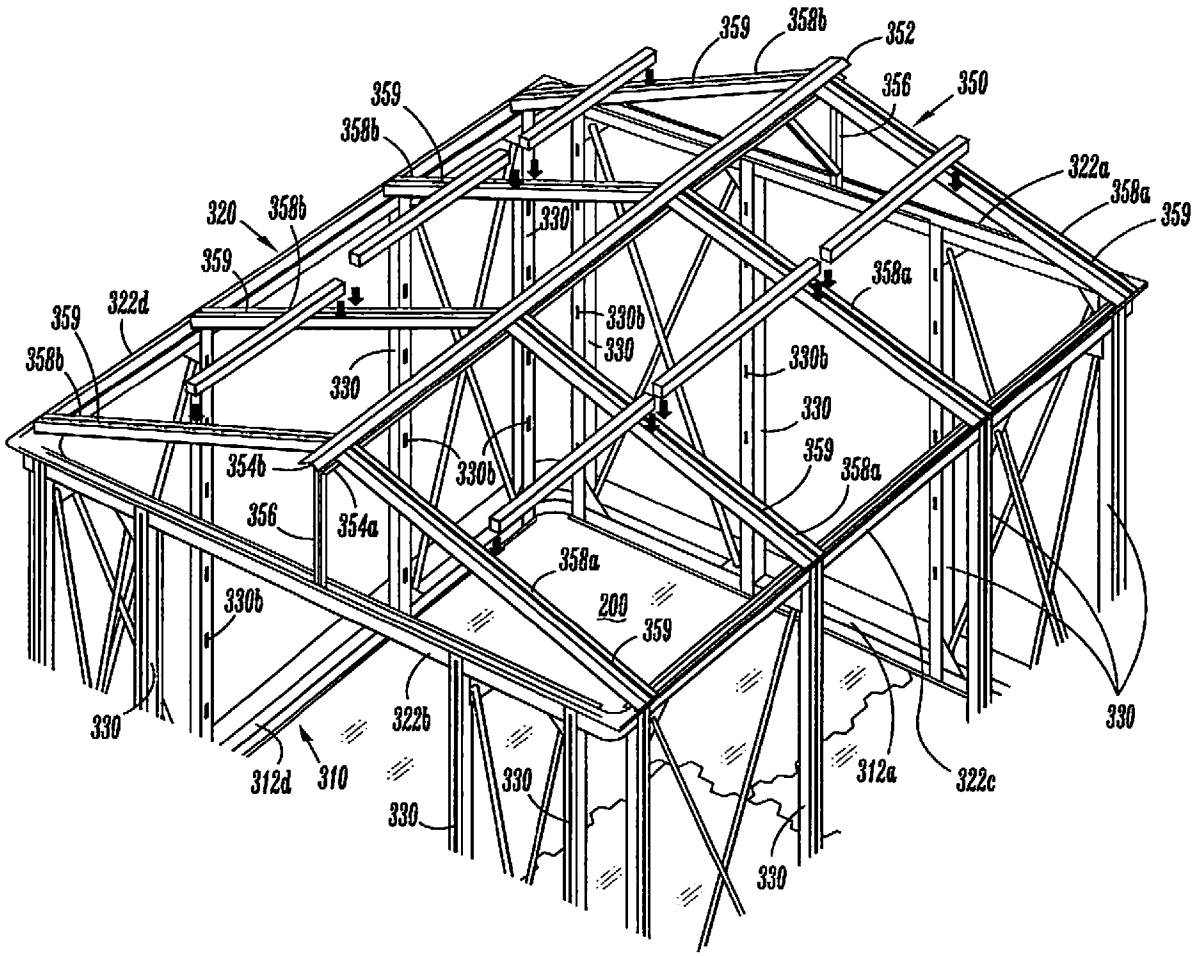
FIG. 5 is a perspective view of the roof frame assembly, in an assembled condition, disposed on the upper frame assembly.

Turning now to FIGS. 2 and 5, upper frame assembly 300 includes a roof frame assembly 350. Roof frame assembly 350 includes a ridge beam 352, first and second ridge cap support members 354*a*, 354*b*, respectively, extending along either side of ridge beam 352, and ridge cap posts 356 extending downwardly from each end of ridge beam 352 for interconnecting ridge beam 352 and ridge cap support members 354*a*, 354*b* to upper rail system 320. Roof frame assembly 350 further includes a first set of rafters 358*a* extending between and interconnecting first ridge cap member 354*a* with first side upper rail 322*c*, and a second set of rafters 358*b* extending between and interconnecting second ridge cap member 354*b* with second side upper rail 322*d*.

External Skin Assembly

Figure 6:
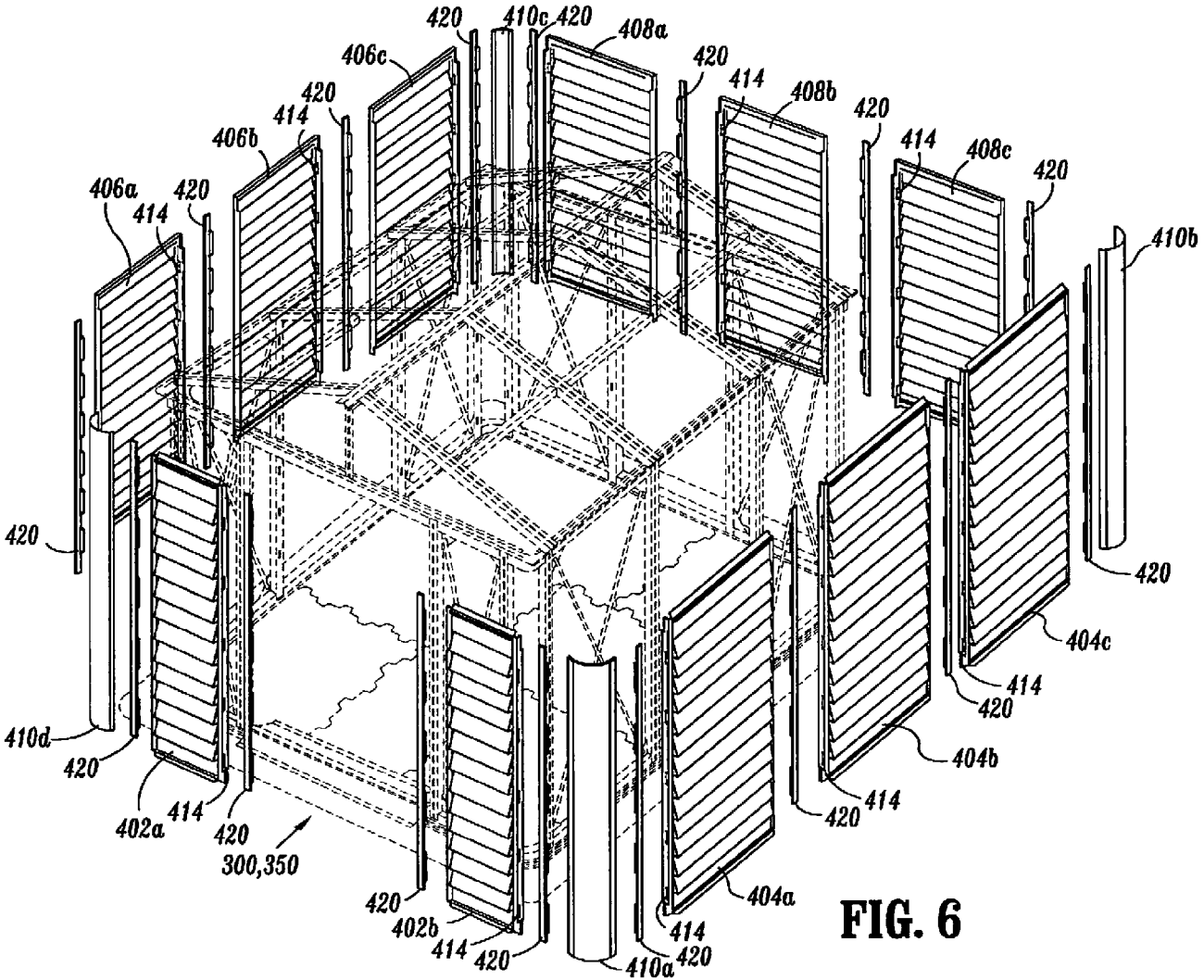
FIG. 6 is an exploded perspective view of an external skin assembly of the modular storage shed with the upper frame assembly and roof frame assembly of FIGS. 4 and 5 (shown in phantom)
Figure 8:
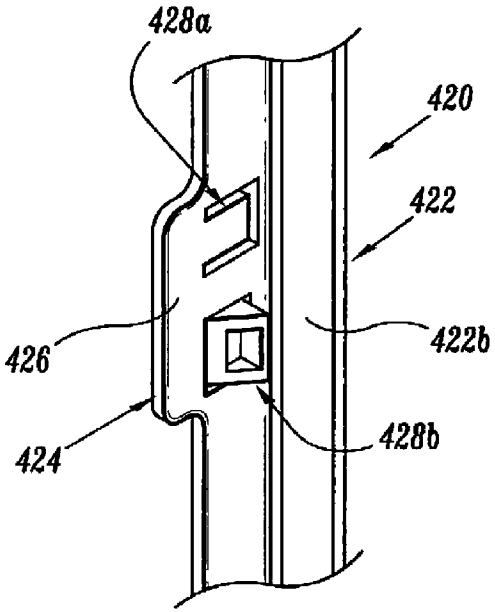
FIG. 8 is an enlarged perspective view of the indicated area of detail of FIG. 7.
Figure 7:
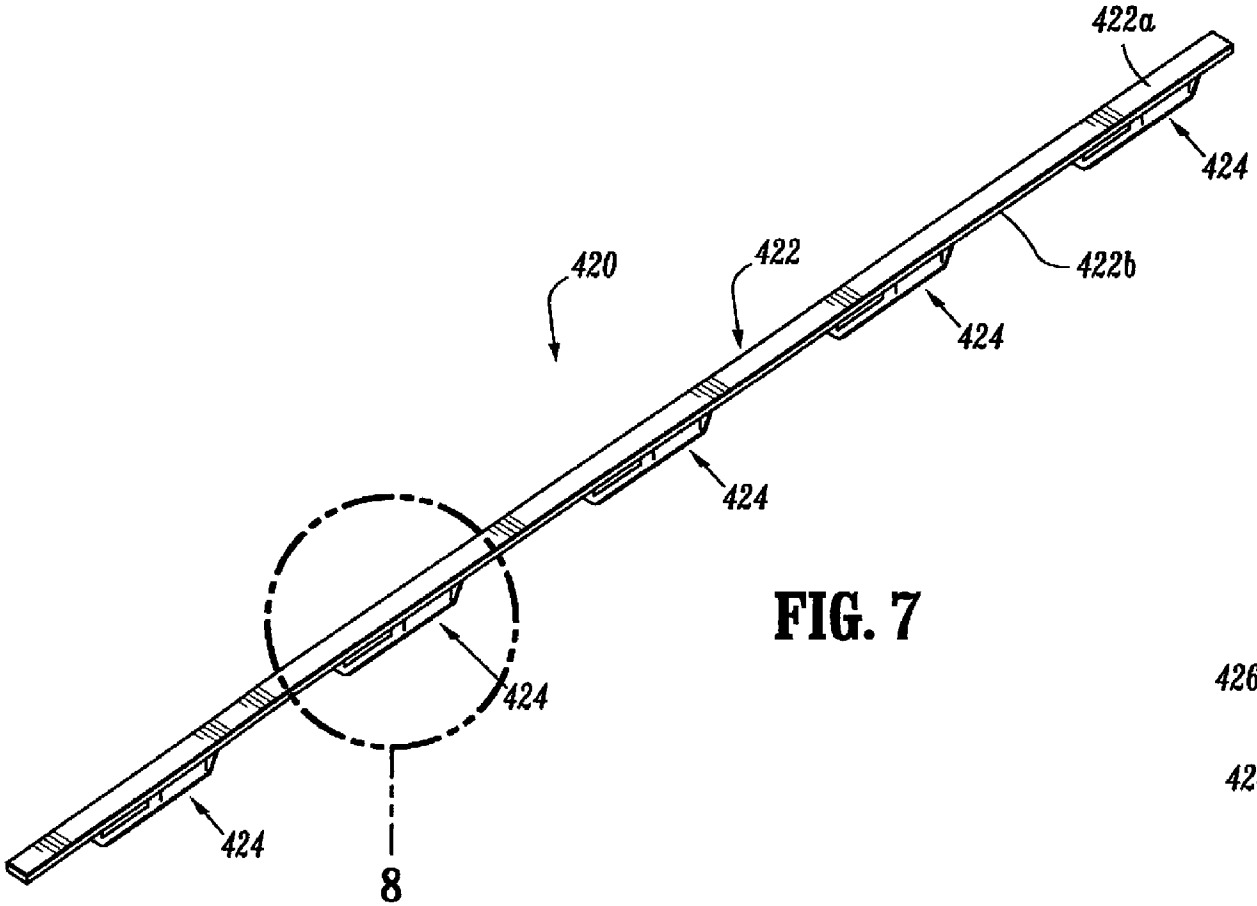
FIG. 7 is a perspective view of a wall panel lock according to the present disclosure.
Figure 10:
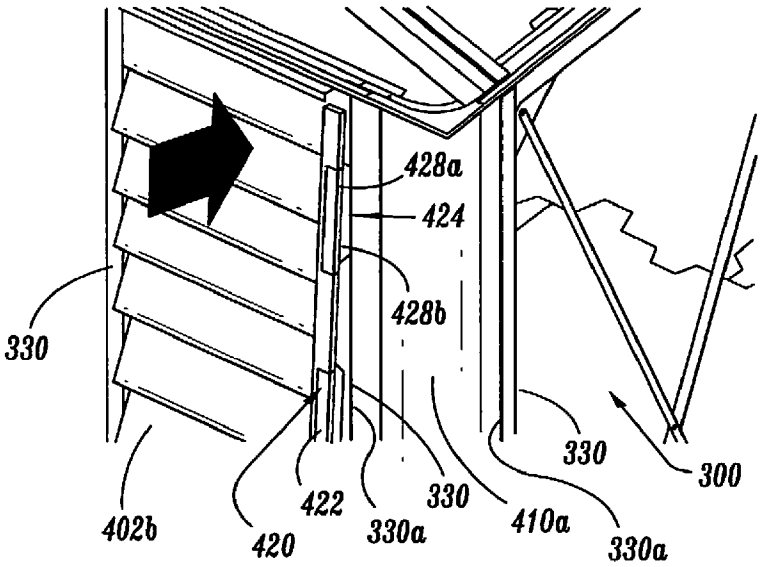
FIG. 10 is a perspective view further illustrating the use of the wall panel lock of FIGS. 8 and 9.

Turning now to FIGS. 3 and 6, a detailed discussion of external skin assembly 400, is provided. External skin assembly 400 desirably includes a pair of front wall panels 402*a*, 402*b*; three right side wall panels 404*a*-404*c*; three left side wall panels 406*a*-406*c*; and three rear wall panels 408*a*-408*c*. External skin assembly 400 further includes corner panels 410*a*-410*d* defining the corners thereof.

Desirably, front wall panels 402*a*, 402*b* may be approximately 12.0 inches wide, right side wall panels 404*a*-404*c* and left side wall panels 406*a*-406*c* may be approximately 31.5 inches wide, and rear wall panels 408*a*-408*c* may be approximately 29.0 inches wide.

As seen in FIGS. 3 and 6, each wall panel includes a lip 412 extending orthogonally from each side edge thereof. Each lip 412 includes a plurality of openings 414 formed therealong. As will be described in greater detail below, during assembly of storage shed 10, each lip 412 of the wall panels is positioned into a channel 330*a* (see FIG. 4) extending along the entire length of vertical post 330.

Wall Panel Locks

External skin assembly 400 further includes a plurality of wall panel locks 420 configured and adapted to secure and/or lock wall panels 402*a*, 402*b*, 404*a*-404*c*, 406*a*-406*c* and 408*a*-408*d* against vertical posts 330 of upper frame assembly 300. Additionally, panel locks 420 function to secure and/or lock corner panels 410*a*-410*d* against vertical posts 330.

As seen in FIGS. 3 and 6-8, each panel lock 420 includes an elongate strip 422 having a first side 422*a* and a second side 422*b*, and a flange 424 extending orthogonally from second side 422*b* of strip 422. Flange 424 includes at least one, preferably a plurality of snap lock members 426 formed in flange 424. Each snap lock member 426 includes a first and a second tab 428*a*, 428*b* projecting from either side thereof. Desirably, each tab 428*a*, 428*b* has a substantially tapered or triangular configuration, wherein a distal end thereof is smaller than a proximal end thereof. A distal edge of each tab 428*a*, 428*b* is integral with or attached to snap lock member 426, and the side edges and rear edge of each tab 428*a*, 428*b* is separated from snap lock member 426.

In this manner, as will be described in greater detail below, in operation, tabs 428*a*, 428*b* may pivot, flex or deflect about the distal edge thereof and snap fit engage openings 414 formed in lips 412 of each wall panel. Desirably, at least snap lock members 426 are made of a polymeric material or electrogalvanized steel providing tabs 428*a*, 428*b* with a degree of resiliency. Most preferably, the entire panel lock 420 is fabricated from a polymeric material, electrogalvanized steel or the like.

Desirably, snap lock members 426 are formed along the length of strip 422 of panel lock 420 at locations which correspond with or register with openings 414 formed in lips 412 of the wall panels.

Turning now to FIGS. 7-10 and 23, a method of using panel locks 420 to secure or lock the wall panels and corner panels to vertical posts 330 of upper frame assembly 300 is shown and described. In the interest of brevity and clarity, only the securing or locking of second front wall panel 402*b* and first corner panel 410*a* to vertical post 330 will be described. It is understood that the securement and/or locking of the other wall panels and corner panels to appropriate vertical posts 330 is accomplished in substantially the same manner.

Figure 9:
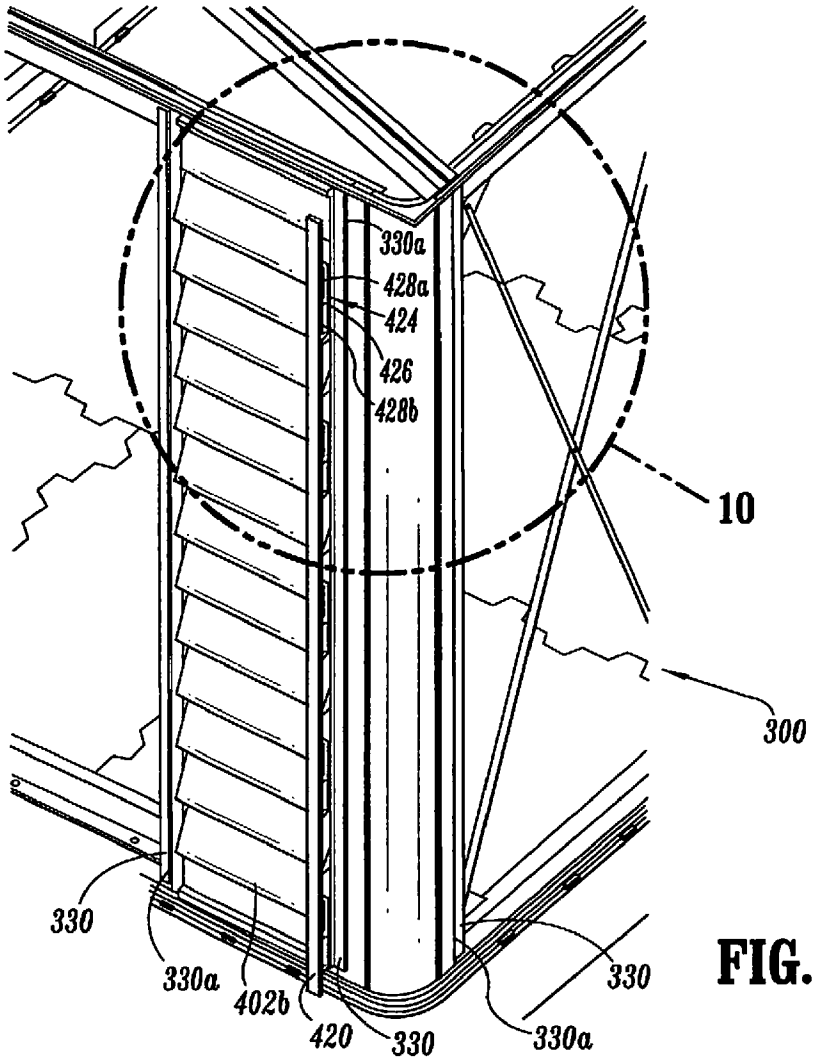
FIG. 9 is a perspective view illustrating the use the wall panel lock of FIG. 8 to attach a wall panel to the upper frame assembly.

As seen in FIG. 9, second front wall panel 402*b* is positioned onto upper frame assembly 330 in a manner such that the right side and left side lips 412 thereof are inserted into channels 330*a* of adjacent vertical posts 330. With lips 412 inserted into channels 330*a* of respective vertical posts 330, a panel lock 420 is used to secure and/or lock second front wall panel 402*b* to adjacent vertical posts 330. In particular, flanges 424, and more particularly, snap lock members 426, of panel lock 420 are inserted into channel 330*a* of vertical post 330, between lip 412 of second front wall panel 402*b* and a side edge of first corner panel 410*a*. When snap lock members 426 are inserted into channel 330*a* of vertical post 330, tabs 428*a*, 428*b* cam against lip 412 or the side edge of second front wall panel 402*b* and pivot about their distal edge. As snap lock members 426 are fully inserted into channel 330*a* of vertical post 330, tabs 428*a*, 428*b* snap into openings 414 formed in lips 412 of second front wall panel 402*b*. The enlarged proximal end of tabs 428*a*, 428*b* help to maintain panel locks 420 secured within channel 330*a* of vertical post 330. Additionally, a width of channels 330*a* of vertical posts 330 tend to enlarge as snap lock members 426 are being inserted therein, thereby facilitating the connection of snap lock members 426 to vertical posts 330.

The remaining wall panels and corner panels may be secured and/or locked on to the remaining vertical posts with additional panel locks 420 in substantially the same manner as described above.

Roof Skin Assembly

Figure 11:
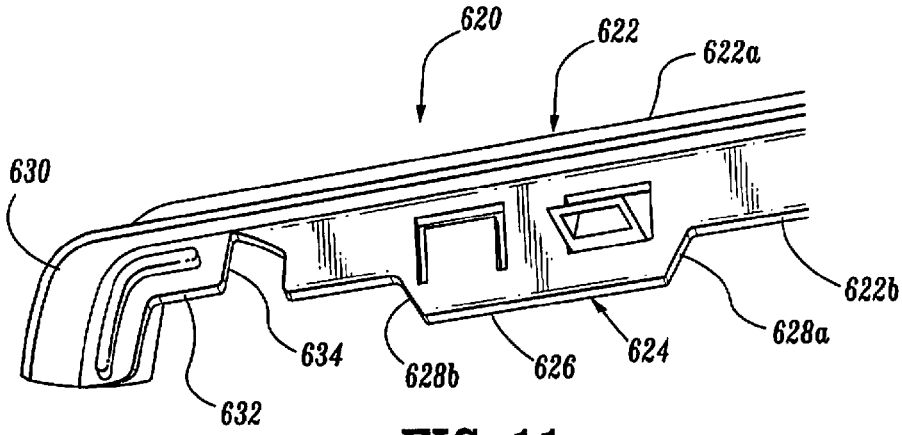
FIG. 11 is a perspective view of a roof panel lock according to the present disclosure.
Figure 12:
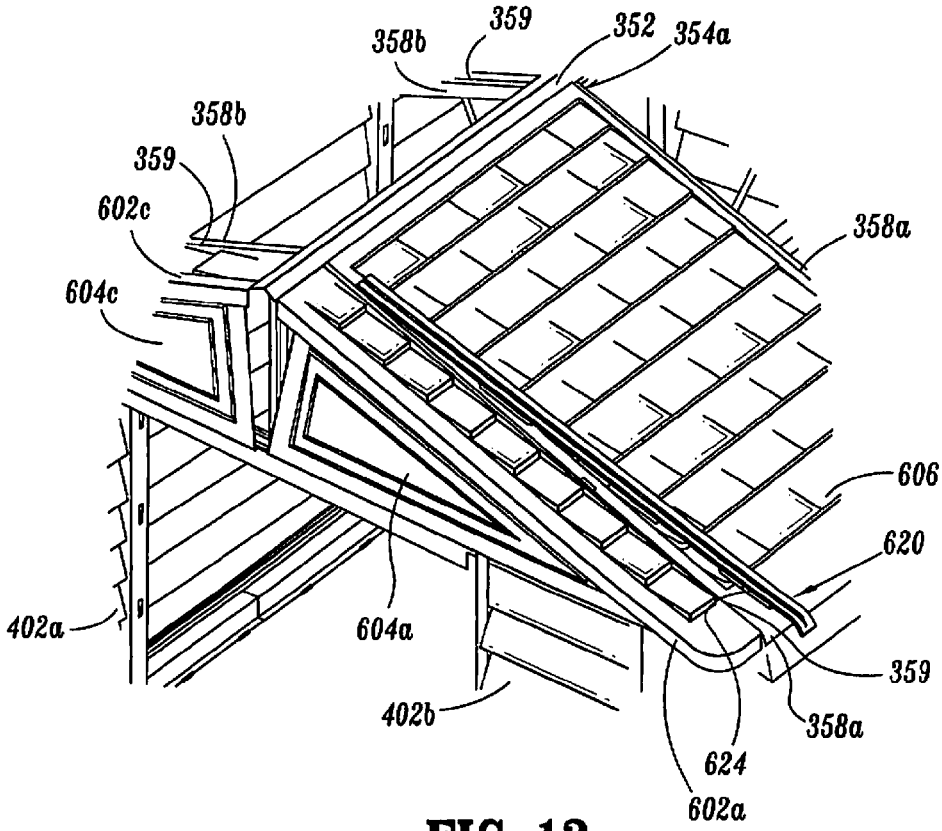
FIG. 12 is a perspective view of a portion of the modular storage shed system of FIG. 1, illustrating the use of the roof panel lock of FIG. 11 to secure or lock the roof panels into position.
Figure 13:
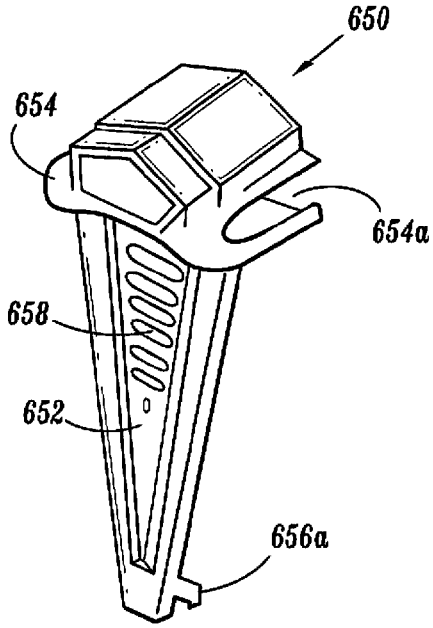
FIG. 13 is a front perspective view of a gable cap according to the present disclosure.
Figure 14:
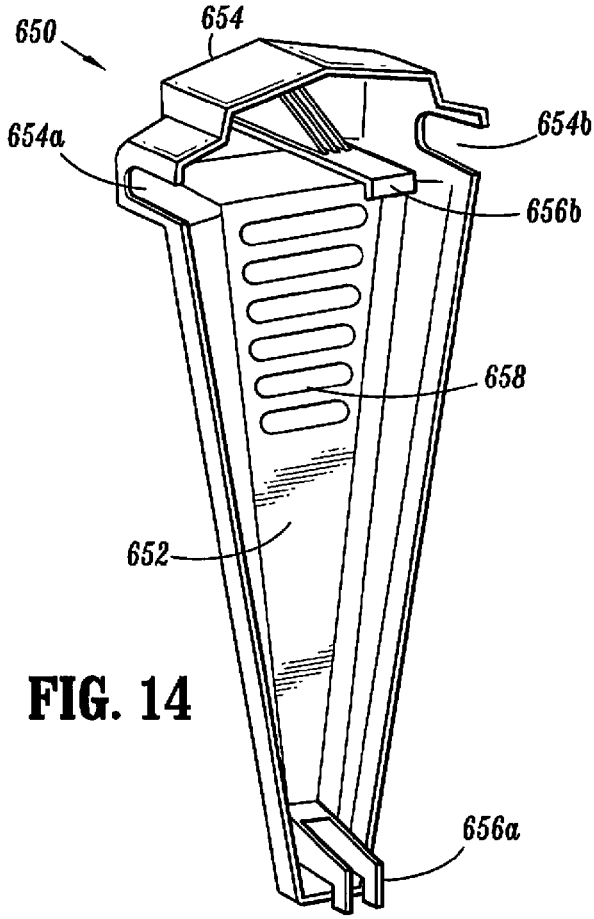
FIG. 14 is a rear perspective view of the gable cap of FIG. 13.

Turning now to FIGS. 3, 11 and 12, a detailed discussion of roof skin assembly 600 and a method of attaching roof skin assembly 600 to roof frame assembly 350 is provided. Roof skin assembly 600 includes a plurality of roof end panels 602, desirably, front and rear right side roof end panels 602*a*, 602*b*, respectively, and front and rear left side roof end panels 602*c*, 602*d*, respectively. Roof skin assembly 600 further includes a plurality of gables 604, desirably, front and rear right side gable 604*a*, 604*b*, respectively, and front and rear left side gable 604*c*, 604*d*, respectively. Roof skin assembly 600 also includes a plurality of roof panels 606.

As seen in FIG. 3, each roof end panel 602*a*-602*d* and each roof panel 606 includes a lip 612 extending orthogonally from at least one side edge thereof, preferably along each side edge of roof panels 606. Each lip 612 includes a plurality of openings 614 formed therealong. As will be described in greater detail below, during assembly of storage shed 10, each lip 612 of roof panels 606 is positioned into a channel 359 (see FIG. 5) extending along the entire length of each rafter 358*a*, 358*b*.

Roof Panel Locks

Roof skin assembly 600 further includes a plurality of roof panel locks 620 configured and adapted to secure and/or lock roof end panels 602*a*-602*d* and roof panels 606 to rafters 358*a* and 358*b* of roof frame assembly 350. As seen in FIGS. 3, 11 and 12, each roof panel lock 620 includes an elongate strip 622 having a first side 622*a* and a second side 622*b*, and a flange 624 extending orthogonally from second side 622*b* of strip 622. Flange 624 includes at least one, preferably a plurality of snap lock members 626 formed in flange 624. Each snap lock member 626 includes a first and a second tab 628*a*, 628*b* projecting from either side thereof. Desirably, each tab 628*a*, 628*b* has a substantially tapered or triangular configuration, wherein a distal end thereof is smaller than a proximal end thereof. A distal edge of each tab 628*a*, 628*b* is integral with or attached to snap lock member 626, and the side edges and rear edge of each tab 628*a*, 628*b* is separated from snap lock member 626.

In this manner, as will be described in greater detail below, in operation, tabs 628*a*, 628*b* may pivot, flex or deflect about the distal edge thereof and snap fit engage openings 614 formed in lips 612 of each roof panel 606. Desirably, at least snap lock members 626 are made of a polymeric material or electrogalvanized steel providing tabs 628*a*, 628*b* with a degree of resiliency. Most preferably, the entire roof panel lock 620 is fabricated from a polymeric material, electrogalvanized steel or the like.

Desirably, snap lock members 626 are formed along the length of strip 622 of roof panel lock 620 at locations which correspond with or register with openings 614 formed in lips 612 of roof panels 606.

As seen in FIG. 11, roof panel locks 620 include a radiused or rounded end 630 which is configured and dimensioned to substantially conform to the shape and/or profile of roof panels 606. Roof panel lock 620 further includes a rib 632 extending substantially orthogonally from an inner surface of rounded end 630. Rib 632 includes a ridge 634 extending from a surface thereof, desirably spaced a distance from rounded end 630. In this manner, rounded end 630 together with ridge 634 extending from rib 632 functions to secure and/or lock the ends of adjacent roof panels 606 to one another.

With reference to FIG. 12, a method of using roof panel lock 620 to secure or lock roof panels 606 and roof end panels 606*a*-606*d* to rafters 358*a*, 358*b* of roof frame assembly 350 is shown and described. In the interest of brevity and clarity, only the securing or locking of a single roof panel 606 and first roof end panel 602*a* to a rafter 358*a* will be described. It is understood that the securement and/or locking of the other roof panels 606 and other roof end panels 602*b*-602*d* to rafters 358*a*, 358*b* of roof frame assembly 350 is accomplished in substantially the same manner.

As seen in FIG. 12, front right side roof end panel 602*a* and a first roof panel 606 are positioned onto roof frame assembly 350 in such a manner that lip 612 of roof end panel 602*a* and lip 612 of roof end panel 602*a* are inserted into channel 359 of rafter 358*a*. With lips 612 of roof panel 606 and roof end panel 602*a* inserted into channel 359 of rafter 358*a*, a roof panel lock 620 is used to secure and/or lock roof end panel 602*a* and roof panel 606 to rafter 358*a*. In particular, flange 624, and more particularly, snap lock member 626, of roof panel lock 620 are inserted into channel 359 of rafter 358*a*, between lip 612 of roof panel 606 and lip 612 of roof end panel 602*a*. When snap lock members 626 are inserted into channel 359 of rafter 358*a*, tabs 628*a*, 628*b* cam against lips 612 or the side edges of roof panel 606 and roof end panel 602*a* and pivot about their distal edge. As snap lock members 626 are fully inserted into channel 359 of rafter 358*a*, tabs 628*a*, 628*b* snap into openings 614 formed in lips 612 of roof panel 606 and roof end panel 602*a*. The enlarged proximal end of tabs 628*a*, 628*b* help to maintain roof panel locks 620 secured within channel 359 of rafter 358*a*.

The remaining roof end panels 602*b*-602*d* and roof panels 606 may be secured and/or locked onto the remaining rafters 358*a*, 358*b* with additional roof panel locks 620 in substantially the same manner as described above.

Gable Caps

Turning now to FIGS. 3 and 13-16, roof skin assembly 600 further includes a pair of gable caps or keystones 650 operatively connectable to the front and the rear of roof frame assembly 350. Each gable cap 650 includes a facie or facade 652, and a bull-nose 654 provided at an upper edge of facie 652. Desirably, bull-nose 654 includes a slot 654*a* formed along either side thereof. Slots 654*a* are configured and dimensioned to slide over the upper-most ends of edge of roof end panels 602*a*-602*b* and effectively cap-off the front and rear ends of roof frame assembly 350.

Figure 15:
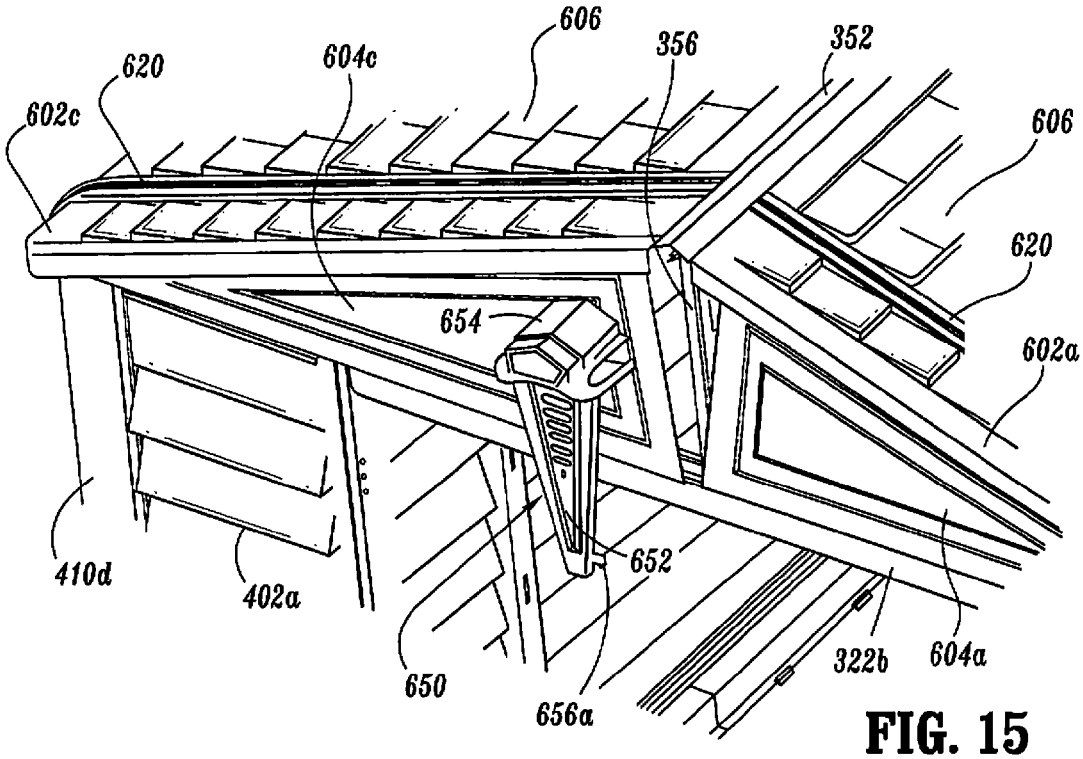
FIG. 15 is a perspective view illustrating the positioning of the gable cap of FIGS. 13 and 14 with respect to the roof assembly.
Figure 16:
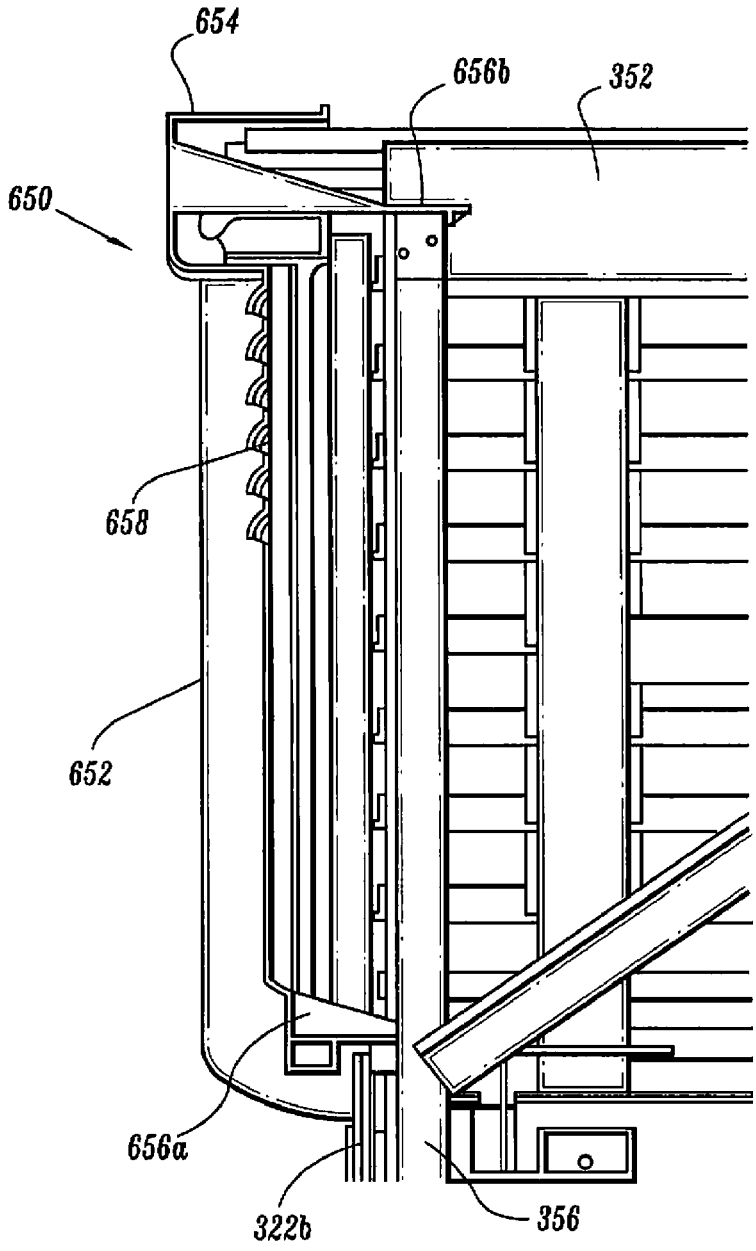
FIG. 16 is a cross-sectional side elevational view of the gable cap of FIGS. 13 and 14 shown operatively associated with the roof assembly.
Figure 17:
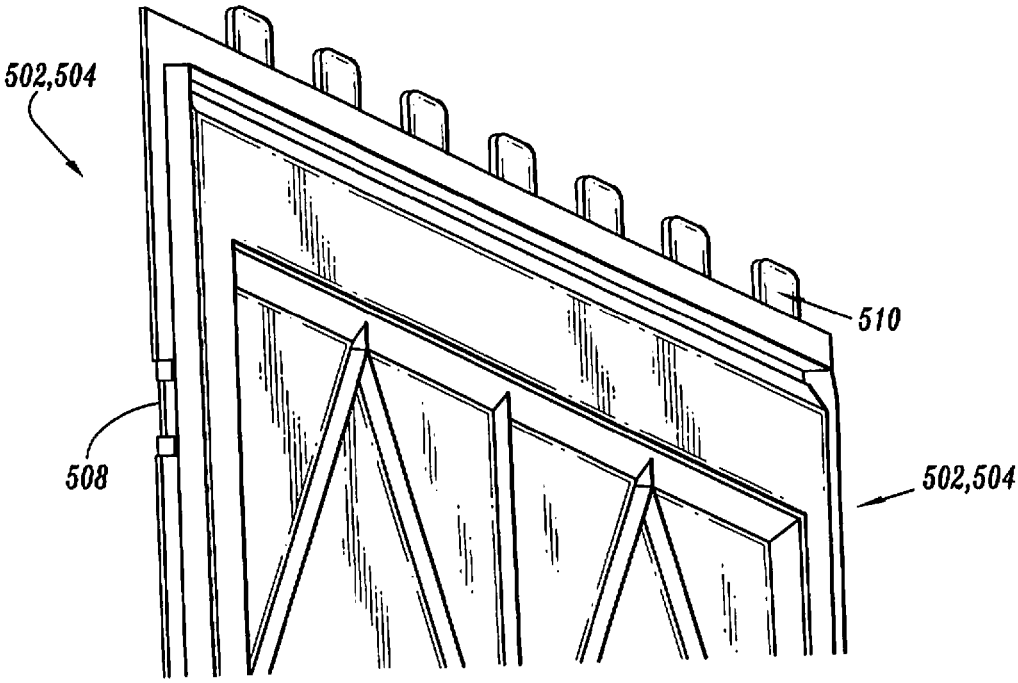
FIG. 17 is a perspective view of a portion of an inner wall panel according to the present disclosure.

Gable caps 650 include a lower hook 656*a* extending from a rear surface of facie 652 near a lower end thereof, and an upper hook 656*b* extending from the rear surface of facie 652 near an upper und thereof. In use, as seen in FIGS. 15 and 16, when connecting gable caps 650 to roof frame assembly 350 and roof skin assembly 600, lower hook 656*a* is hooked onto front upper rail 322*b* of upper frame assembly 300, between front right and left side gables 604*a*, 604*c*, respectively. Next, upper hook 656*b* is hooked onto the top of ridge cap post 356.

Desirably, each gable cap 650 includes apertures (e.g., vents, a grill, etc.) 658 formed in facie 652. Apertures 658 formed in facie 652 of gable caps 650 provide for a degree of ventilation and/or air flow to enter modular storage shed 10. Additionally, apertures 658 allow for any evaporated water and/or heat to escape from the interior of modular storage shed 10.

Internal Skin Assembly

Turning now to FIGS. 3 and 17-23, a detailed discussion of internal skin assembly 500 and a method of attaching internal skin assembly 600 to upper frame assembly 300, is provided. Internal skin assembly 500 desirably includes a plurality of front inner wall panels 502, a plurality of right side, left side and rear inner wall panels 504, and a plurality of corner inner panels 506.

Desirably, each inner wall panel 502, 504 includes at least one recess or cut-out 508 formed along each side edge thereof. In use, when inner wall panels 502, 504 are placed adjacent one another, recesses 508 from one inner wall panel 502, 504 align with and/or register with recesses 508 from an adjacent inner wall panel 502, 504. Recesses 508 are configured and dimensioned to selectively receive and engage wall snaps 520, as will be described in greater detail below.

Figure 18:
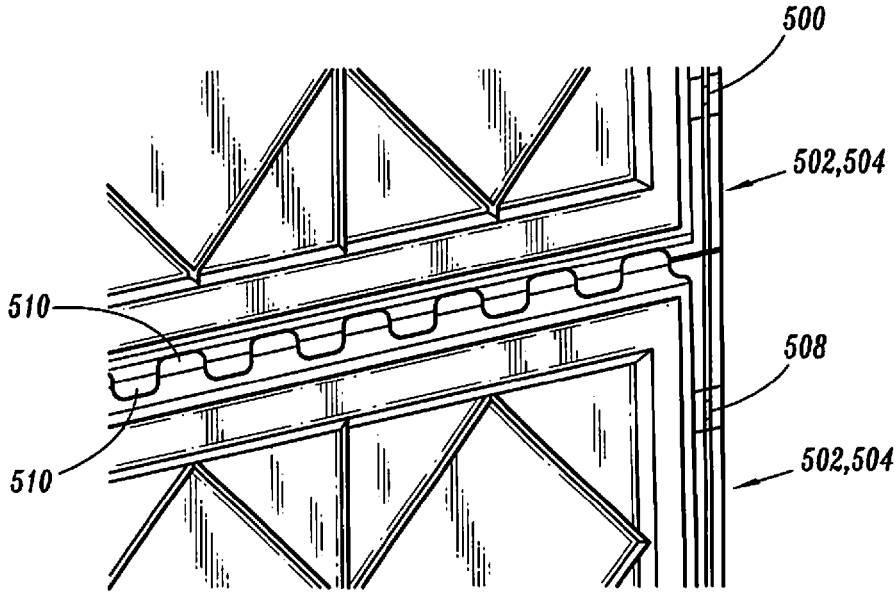
FIG. 18 is a perspective view illustrating the connecting of an upper and a lower inner wall panel to one another.

Each inner wall panel 502, 504 includes a series of evenly spaced apart fingers or tabs 510 extending from and along an upper or lower edge thereof. Desirably, in use, as seen in FIG. 18, tabs 510 extending along an upper edge of a lower inner wall panel 502, 504 are configured and dimensioned to engage (e.g., inter-digitate with) tabs 510 extending along a lower edge of an upper inner wall panel 502, 504.

Desirably, inner wall panels 502, 504 have a width such that inner wall panels 502, 504 are placed against upper frame assembly 300, the side edges thereof overlie posts 330. Additionally, inner wall panels 502, 504 have a height such that when a pair of wall panels are placed atop one another, an upper edge of the combined wall panel substantially overlies upper rail 322 of upper frame assembly 300 when a lower edge of the combined wall panel rests on base frame assembly 200 (see FIG. 4).

Desirably, front inner wall panels 502 may be approximately 12.0 inches wide, the right side inner wall panels and the left side inner wall panels may be approximately 31.5 inches wide, and the rear inner wall panels may be approximately 29.0 inches wide.

Inner Wall Snaps

Figure 19:
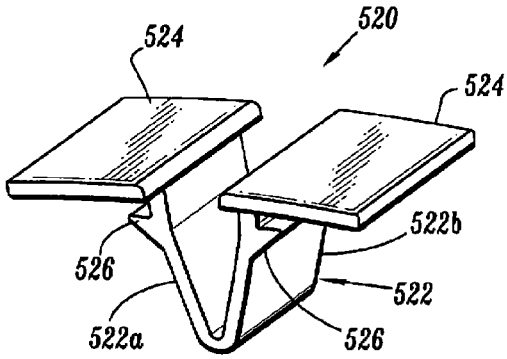
FIG. 19 is a perspective view of an inner wall snap according to the present disclosure.
Figure 20:
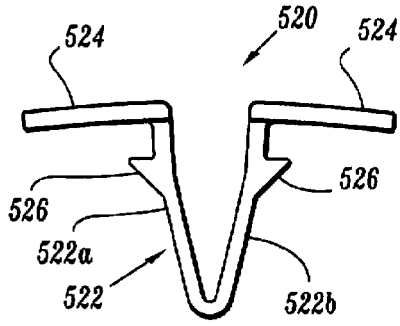
FIG. 20 is an elevational view of the inner wall snap of FIG. 19 shown in an un-biased condition.
Figure 21:
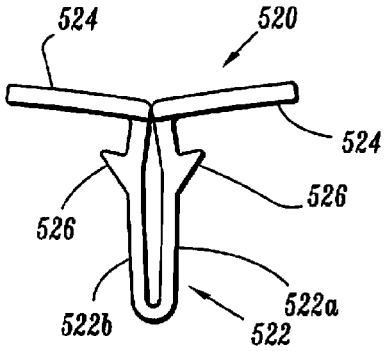
FIG. 21 is an elevational view of the inner wall snap of FIG. 19 shown in a biased condition.

Inner skin assembly 500 further includes a plurality of inner wall snaps 520. As seen in FIGS. 17-23, inner wall snaps 520 include a substantially V-shaped biasing member 522 having a first side member 522*a* and a second side member 522*b*, respectively, a flange 524 extending from an upper end of each side member 522*a*, 522*b* of biasing member 522, and a tab 526 extending outwardly from each side member 522*a*, 522*b* of biasing member 522. Tabs 526 are spaced a distance from flanges 524. Snaps 520 have an unbiased condition, as seen in FIGS. 19 and 20, wherein the upper ends of side members 522*a*, 522*b* are spaced from one another, and a biased condition, as seen in FIG. 21, wherein the upper ends of side members 522*a*, 522*b* are approximated toward and/or in contact with one another.

Figure 22:
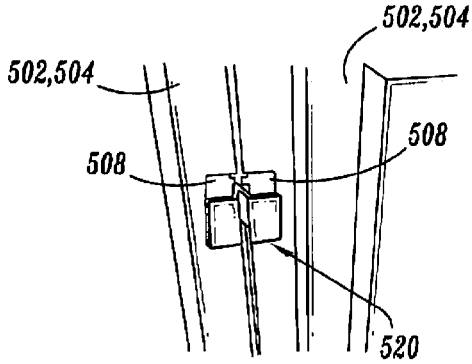
FIG. 22 is a perspective view illustrating the use of the inner wall snaps of FIGS. 19-21 to connect adjacent inner wall panels to one another.
Figure 23:
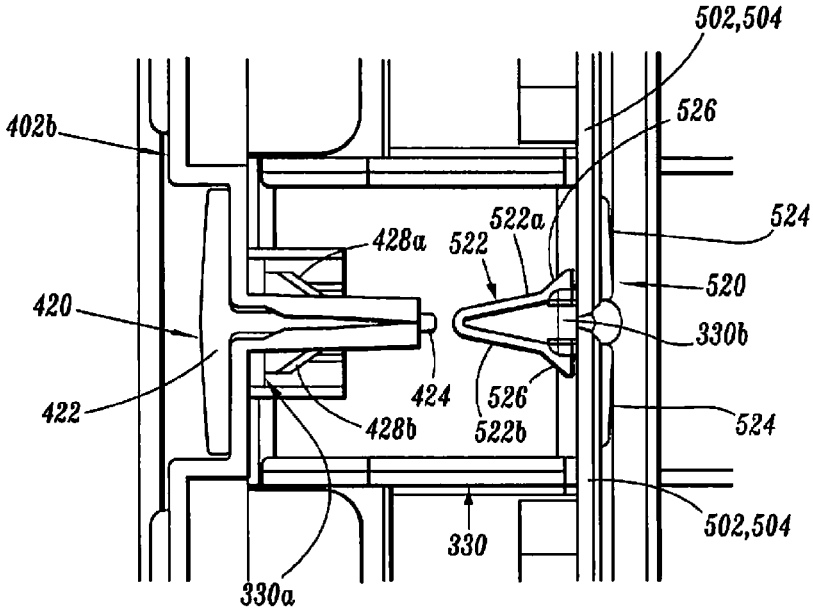
FIG. 23 is a transverse cross-sectional view of the internal and external skin assemblies, illustrating the use of the wall panel lock of FIGS. 8 and 9 and the inner wall snap of FIGS. 19-21.

With reference to FIGS. 22 and 23, a method of using inner wall snaps 520 to secure inner wall panels 502, 504 and corner panels 506 to posts 330 of upper frame assembly 300 is shown and described. In the interest of brevity and clarity, only the securing of a single inner wall panel 502, 504 to a pair of adjacent posts 330 of upper frame assembly 300 will be described. It is understood that the securement of the other inner wall panels and corner panels 506 to posts 330 is accomplished in substantially the same manner.

Securing of inner wall panel 502 or 504 to upper frame assembly 300 includes positioning a first inner wall panel 502, 504 against a pair of adjacent posts 330 of upper frame assembly 300. In particular, the inner wall panel 502 or 504 is positioned against the pair of adjacent posts 330 such that recesses 508 provided along the side edges of inner wall panel 502 or 504 are aligned with or in registration with slots or apertures 330*b* formed along a rear surface of each post 330 (see FIGS. 2, 4, 5 and 23). Desirably, another or second inner wall panel 502 or 504 is positioned adjacent the first inner wall panel 502 or 504.

With adjacent inner wall panels 502 or 504 in position, inner wall snaps 520 may be pressed between adjacent recesses 508 of inner wall panels 502 or 504 and into aperture 330*b* of post 330. As inner wall snap 520 is pressed into aperture 330*b* of post 330, biasing member 522 is urged to the biased condition, as described above until tabs 526 clear (e.g., move past) post 330. Once tabs 526 move past post 330, biasing member 522 returns to the un-biased condition, effectively snapping inner wall snap 520 into position and securing or locking inner wall panel 502, 504 against the adjacent posts 330. Flanges 524 prevent inner wall snaps 520 from being pressed completely into aperture 330*b* of post 330 and falling therein. Additionally, flanges 524 help to maintain inner wall panel 502 or 504 pressed against post 330.

It is contemplated that inner wall panels 502, 504 may be and are not limited to smooth surfaced panels, peg board panels, raised panels, and the like, or any combination thereof.

Base Panel Assembly

Turning now to FIGS. 2, 4, 24 and 25, a detailed discussion of base panel assembly 200 is provided. Base panel assembly 200 includes a plurality of base panels 202 (e.g., corner panels 202*a*, side middle panels 202*b*, front center panel 202*c*, and rear center panel 202*d*, see FIG. 2) which may be selectively joined together to define and form base panel assembly 200.

Desirably, the edges of base panels 202, which are to form or define the outer perimeter of base panel assembly 200, include a smooth, preferably, slanted edge 204. Additionally, the edges of base panels 202, which are to abut against adjacent base panels, define a stepped or keyed edge 206. Each stepped edge 206 includes a series of upper teeth 208*a* and a series of lower teeth 208*b* extending from stepped edge 206.

Figure 24:
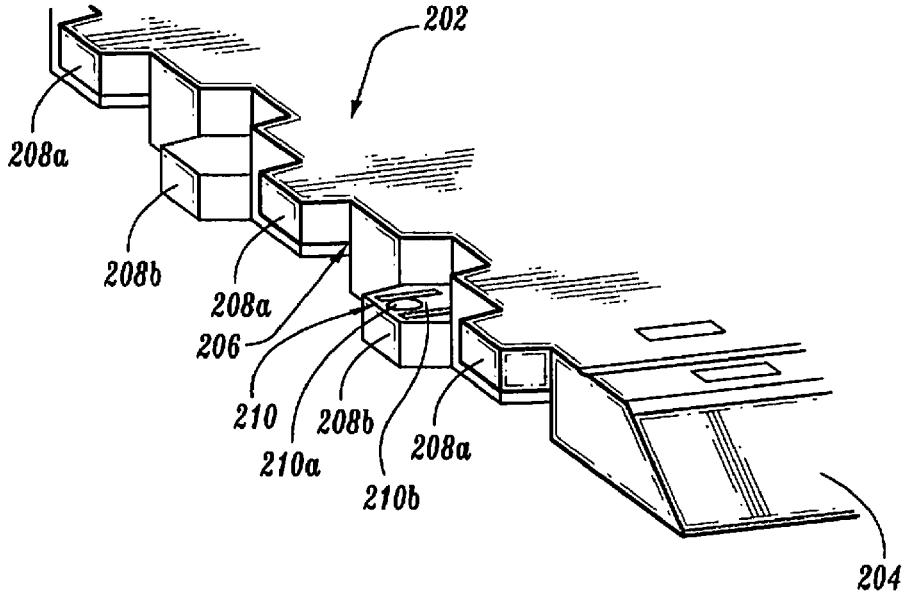
FIG. 24 is an enlarged perspective view of the indicated area of detail of FIG. 2, illustrating the toothed side edge of a floor panel of the modular storage shed system.
Figure 25:
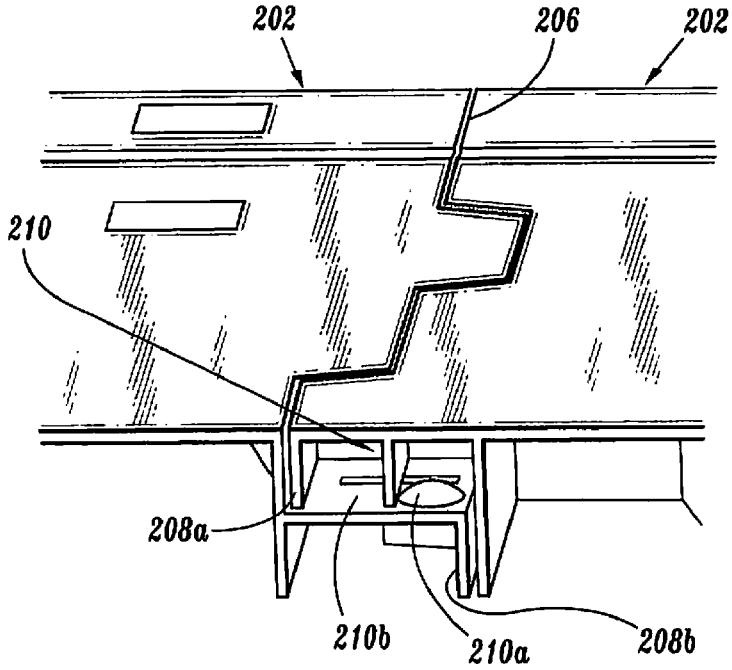
FIG. 25 is a cross-sectional perspective view of a pair of floor panels operatively connected to one another.

As seen in FIGS. 24 and 25, at least one lower tooth 208*b* of stepped edge 206 includes an engaging member 210 (e.g., a snap-fit engaging member) configured and dimensioned to selectively engage an under side of a juxtaposed upper tooth 208*a*. Accordingly, when adjacent base panels 202 are connected to one another, engaging member 210 secures the adjacent base panels 202 to one another in a snap-fit type engagement. Desirably, engaging member 210 includes a projection or dome 210*a* extending from an upper surface of lower tooth 208*b*, preferably, a cantilevered arm 210*b* formed in the upper surface of lower tooth 208*b*.

It is envisioned that upper frame assembly 300 and roof frame assembly 350 may be fabricated from metal (e.g., galvanized steel, electrogalvanized steel, stainless steel, etc.). It is further envisioned that external skin assembly 400, internal skin assembly 500 and roof skin assembly 600 may be fabricated from resin injected materials and the like.

Door Assembly

Turning now to FIGS. 1, 3 and 26-29, a detailed discussion of door assemblies 30*a*, 30*b* is provided. Each door assembly 30*a*, 30*b* includes a door frame 32, an outer panel or shell 34 selectively connectable to door frame 32, and optionally an inner panel or shell 36 also selectively connectable to door frame 32.

Figure 27:
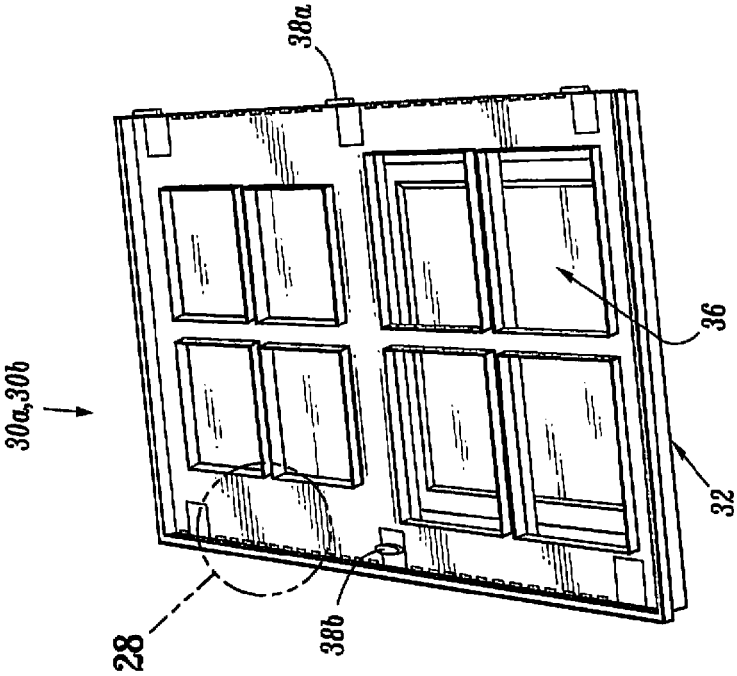
FIG. 27 is a rear perspective view of the door assembly of FIG. 26 with a shell removed from the door frame.
Figure 26:
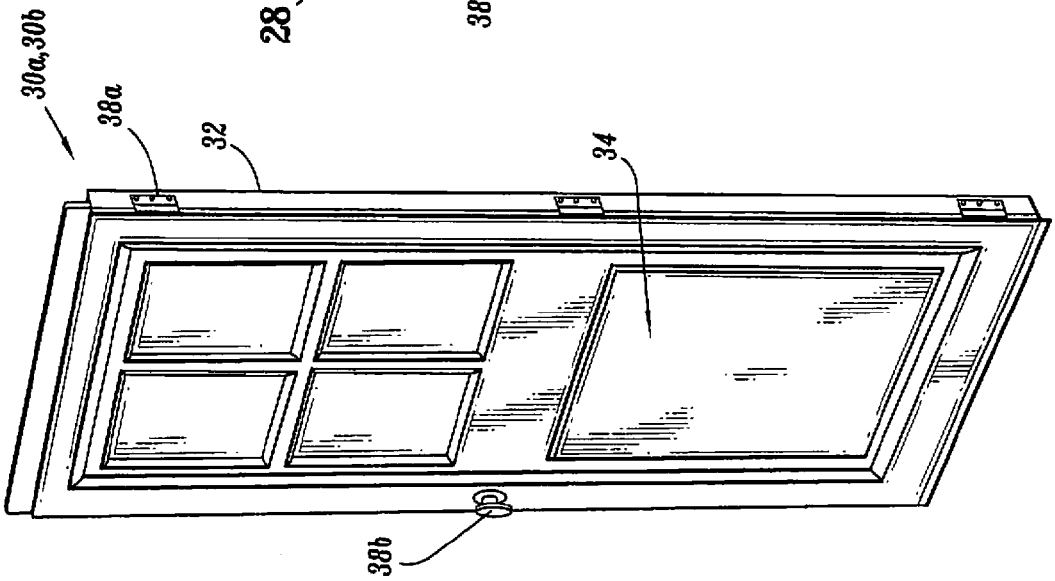
FIG. 26 is a front perspective view of a door assembly of the modular storage shed system.

As seen in FIGS. 26 and 27, door frame 32 is configured and adapted to support and/or fit the necessary working parts such as, for example, hinges 38*a* for connecting door assembly 30*a* or 30*b* to vertical posts 330, handles 38*b* for opening and closing door assemblies 30*a*, 30*b*, and locking mechanisms (not shown) for locking and unlocking door assemblies 30*a*, 30*b*.

Figure 28:
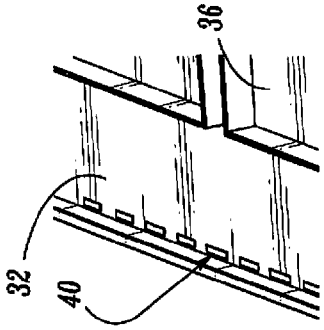
FIG. 28 is an enlarged perspective view of the indicated area of detail of FIG. 27.
Figure 29:
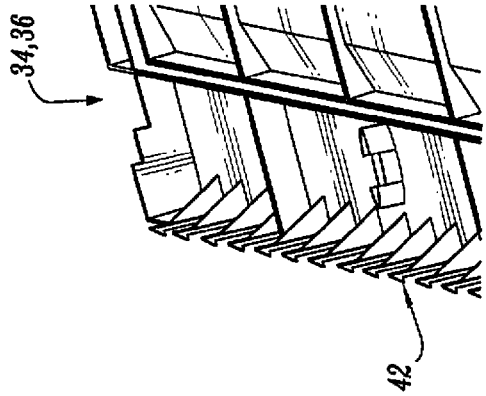
FIG. 29 is an enlarged perspective view of a portion of an inner surface of a shell for selective attachment to the door frame.

As seen in FIGS. 27 and 28, an inner and outer surface of each door frame 32 include a series of slots 40 formed along opposed side edges thereof. Slots 40 are configured and dimensioned to receive fingers or tabs 42 extending orthogonally from an inner surface of panels 34, 36 (see FIG. 29). Desirably, fingers 42 extend along either side of panels 32, 34, at a location for inter-engagement with slots 40 formed in door frames 32. Preferably, fingers 42 are configured and dimensioned to snap-fit engage slots 40. In use, panels 32, 34 are snapped onto the outer and/or inner surface of door frames 32, 34, thus creating a unitary, light-weight door assembly 30*a*, 30*b*.

Modular storage shed system 20 constructed in accordance with the present disclosure is a lightweight, strong and inexpensive building that is relatively simple to assembly and that can be packaged in relatively compact shipping containers for transport from the place of purchase to the site on which the storage building is to be erected.

Numerous modifications and alternative embodiments of the present disclosure will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

What is claimed is:

1. A modular storage shed system, comprising:

an upper frame assembly including a plurality of vertically oriented posts, each post defining an elongated slot extending axially along at least a portion of a length thereof; and an external skin assembly including:

a plurality of external wall panels each defining a pair of side edges, each wall panel including a lip extending orthogonally from at least a portion of each side edge thereof, each lip defining at least one aperture formed therein; and a plurality of panel locks including an elongate strip, a lock member extending orthogonally from and at least along a portion of a length of the elongate strip, and resilient tabs projecting outwardly from each side of the lock member, wherein the tabs snap-fit engage the apertures in the lips of the wall panels when the lips of adjacent wall panels are positioned within the slot of a common vertical post and the lock member of the panel lock is pressed between the adjacent wall panels into the slot of the vertical post.

2. The storage shed system according to claim 1, wherein the tabs taper downwardly in a distal direction.

3. The storage shed system according to claim 2, wherein a distal edge of each tab is integral with the lock member and a rear and side edges of each tab is separated from the lock member.

4. The storage shed system according to claim 1, further comprising:

a roof frame assembly including a plurality of rafters, each rafter defining a channel extending axially along at least a portion of a length thereof; and a roof skin assembly including:

a plurality of roof panels each defining a pair of side edges, each roof panel including a lip extending orthogonally from at least a portion of each side edge thereof, each lip defining at least one aperture formed therein; and a plurality of roof panel locks including an elongate strip, a lock member extending orthogonally from and at least along a portion of a length of the elongate strip, and resilient tabs projecting outwardly from each side of the lock member, wherein the tabs snap-fit engage the apertures in the lips of the roof panels when the lips of adjacent roof panels are positioned within the channel of a common rafter and the lock member of the roof panel lock is pressed between the adjacent roof panels into the channel of the rafter.

5. The storage shed system according to claim 4, further comprising:

an internal skin assembly including:

a plurality of inner wall panels, each inner wall panel includes at least one recess formed along each side edge thereof, and a series of tabs extending along at least one of an upper and a lower edge thereof; and a plurality of inner wall snaps including a biasing member configured to snap-fit engage apertures formed in the vertical posts.

6. The storage shed system according to claim 5, wherein each vertical post includes a series of apertures formed therein, wherein the apertures formed in the vertical post are disposed along a side opposite the vertical slot.

7. The storage shed system according to claim 6, wherein each inner wall snap includes:

a V-shaped biasing member having a first side member and a second member; and a tab extending outwardly from each of the first and second side members, wherein inner wall snaps have an un-biased condition in which the tabs are spaced a distance from one another and a biased condition in which the tabs are in relative close proximity to one another.

8. The storage shed system according to claim 7, wherein inner wall snaps deflect to the biased condition upon pushing inner wall snaps into the apertures of the vertical posts, and wherein the inner wall snaps return to the un-biased condition when the tabs of the first and second side members completely enter the aperture of the vertical post.

9. The storage shed system according to claim 8, wherein the roof skin assembly further includes a pair of gable caps each configured to operatively engage the roof frame assembly, each gable cap includes:

a facie;

a bull-nose provided at an upper edge of the facie;

a lower hook extending from a rear surface of the facie proximate a lower end thereof, the lower hook is configured to operatively engage an upper rail of the upper frame assembly; and an upper hook extending from the rear surface of the facie proximate an upper end thereof, the upper hook is configured to operatively engage a ridge cap post of the roof frame assembly.

10. The storage shed system according to claim 9, further comprising:

a base panel assembly configured and dimensioned to support the upper frame thereon, the base panel assembly including:

a plurality of base panels configured and dimensioned to selectively engage one another, wherein the edges of the base panels which are to engage one another have a stepped profile, the stepped edges of the base panels include a series of upper teeth configured and dimensioned to operatively engage a series of lower teeth provided on the stepped edge of an adjacent base panel.

11. The storage shed system according to claim 10, wherein at least one tooth of the series of lower teeth provided along a stepped side edge of the base panel includes an engaging member projecting therefrom, the projecting member is configured to operatively engage a juxtaposed upper tooth of the series of upper teeth provided along a stepped side edge of an adjacent base panel.

12. Panel locks for use with a modular storage shed system including:

an upper frame assembly including a plurality of vertically oriented posts, each post defining an elongated slot extending axially along at least a portion of a length thereof; and an external skin assembly including a plurality of external wall panels each defining a pair of side edges, each wall panel including a lip extending orthogonally from at least a portion of each side edge thereof, each lip defining at least one aperture formed therein; each panel lock comprising:

an elongate strip having a first side and a second side;

a flange extending orthogonally from and at least along a portion of a length of the second side of the elongate strip; and a plurality of snap lock members formed in the flange, each snap lock member includes a first and a second tab projecting from either side thereof, wherein the tabs snap-fit engage the apertures in the lips of the wall panels when the lips of adjacent wall panels are positioned within the slot of a common vertical post and the lock member of the panel lock is pressed between the adjacent wall panels into the slot of the vertical post.

* * * * *